US010900148B2

(12) United States Patent
Howland

(10) Patent No.: US 10,900,148 B2
(45) Date of Patent: Jan. 26, 2021

(54) PROTECTIVE MID-COVER TEXTILES

(71) Applicant: WARWICK MILLS, INC., New Ipswich, NH (US)

(72) Inventor: Charles A Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 490 days.

(21) Appl. No.: 14/206,076

(22) Filed: Mar. 12, 2014

(65) Prior Publication Data

US 2014/0272361 A1 Sep. 18, 2014

Related U.S. Application Data

(60) Provisional application No. 61/779,250, filed on Mar. 13, 2013.

(51) Int. Cl.
*D03D 13/00* (2006.01)
*D03D 1/00* (2006.01)

(52) U.S. Cl.
CPC ..... *D03D 13/008* (2013.01); *D03D 1/0052* (2013.01); *D10B 2331/021* (2013.01);
(Continued)

(58) Field of Classification Search
CPC ..... D03D 1/0052; D03D 13/008; D03D 2700/0137; D03D 2700/0196; F41H 1/02;
(Continued)

(56) References Cited

U.S. PATENT DOCUMENTS 5,187,003 A * 2/1993 Chitrangad ..... D03D 1/0052 139/420 A
5,565,264 A 10/1996 Howland
(Continued)

FOREIGN PATENT DOCUMENTS

EP 0 412 196 A1 2/1991
JP 2011522199 A 7/2011

OTHER PUBLICATIONS

DuPont, Technical Guide Kelvar® Aramid Fiber. http://www.dupont.com/content/dam/dupont/products-and-services/fabrics-fibers-and-nonwovens/fibers/documents/Kevlar_Technical_Guide.pdf. Retrieved Jul. 19, 2016.*
(Continued)

*Primary Examiner* — Jennifer A Gillett
(74) *Attorney, Agent, or Firm* — Maine Cernota & Rardin

(57) ABSTRACT

A new class of protective fabrics having good ballistic and fragmentary protection also provide wearable drape, softness, and moisture transport, as well as good UV and abrasion resistance and color acceptance, making them comfortable to wear as garment fabrics. The protective fabrics are constructed from yarns having at least 20% ballistic fibers with greater than 12 gpd tenacity. A combined cover factor of between 55% and 80% avoids added stiffness due to yarn distortion at the crossing points. In embodiments, a long-float weave such as twill or satin with reduced crossing point density improves the hand of the fabric, and in some embodiments provides a different character on each face so that a predominantly staple fabric face is in contact with skin of a user, thereby providing better wearing comfort than a plain weave.

44 Claims, 13 Drawing Sheets

(52) U.S. Cl.
CPC ... *D10B 2401/063* (2013.01); *Y10T 442/3065* (2015.04); *Y10T 442/3179* (2015.04)

(58) Field of Classification Search
CPC ..... F41H 5/04; D10B 2331/021; D10B 2401/063
USPC ..... 442/135, 131
See application file for complete search history.

(56) References Cited

U.S. PATENT DOCUMENTS 5,928,971 A * 7/1999 Ellis ..... A41D 31/0022 442/118
5,935,881 A * 8/1999 Abiru ..... D03D 15/00 28/282
6,610,618 B1 * 8/2003 Bottger ..... D03D 1/0052 2/2.5
2002/0111099 A1 8/2002 Howland
2003/0008583 A1 * 1/2003 Chiou ..... D03D 1/0052 442/239
2003/0109188 A1 * 6/2003 Hartert ..... B32B 5/26 442/135
2007/0105468 A1 * 5/2007 Chiou ..... A41D 31/0061 442/181
2007/0232173 A1 * 10/2007 Bain ..... B32B 5/08 442/239
2007/0249247 A1 * 10/2007 Truesdale, III ..... D06M 13/127 442/136
2008/0248708 A1 * 10/2008 Peacock ..... D02G 3/047 442/187
2009/0291280 A1 * 11/2009 Hartert ..... D03D 1/0052 428/218
2010/0029159 A1 2/2010 Ishihara et al.
2010/0124862 A1 5/2010 Smith
2010/0275764 A1 * 11/2010 Egres, Jr. ..... B32B 5/12 89/36.02
2012/0183747 A1 * 7/2012 Bader ..... A41D 31/0022 428/195.1

OTHER PUBLICATIONS

Aramid Fibers. http://www.chem.uwec.edu/Chem405_S01/malenirf/project.html. retrieved Feb. 22, 2007, Wayback Machine.*
PCT Search Report dated Dec. 16, 2014 for PCT Application No. PCT/US2014/024182, filed Mar. 12, 2014, 12 pages.
Great Britain Search Report for Appl No. GB1517233.1 dated Jun. 3, 2019, 4 pages.

* cited by examiner

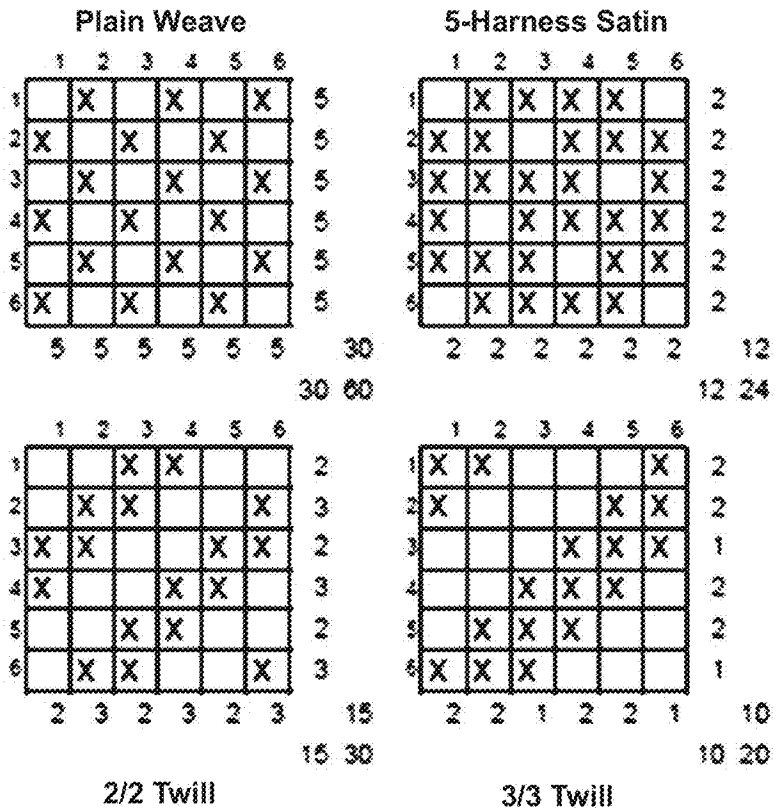
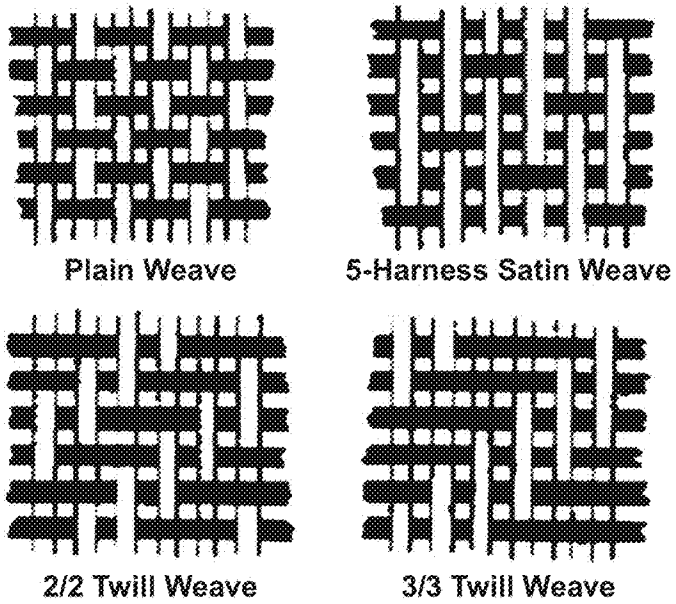
| Crossing point per 6/6 unit cell | |
|---|---|
| Plain Weave | 60 |
| | |
| 5-Harness Satin | 24 |
| Ratio to Plain weave | 40% |
| | |
| 2/2 Twill | 30 |
| Ratio to Plain weave | 50% |
| | |
| 3/3 Twill | 20 |
| Ratio to Plain weave | 33% |
Figure 8

DC965-192-300

| Fabric | Discription | Cicular bending | Ref | Martindale on 400 grit | 2 grain frag | Cut test 1790 |
|---|---|---|---|---|---|---|
| T9-1408 | Liner | | | | | |
| T9-1343 | Bothe | | | | | |
| T9-1396 | Pant twill | 2.24 | x | 6042 | 482 | |
| T9-1424 | SPS twill | | | | 747 | |
| T9-1400 | Jacket | 5.25 | x | 7181 | x | |
| T9-1263 | TS PA staple | x | x | x | x | x |
| T9-1334 | TS PET filament | | | | | |
| T9-1094 | TS stab | | | | x | x |
| T9-1398 | Oxford | x | x | x | | |
| T9-1285 | Ballistics | | | | | |

Notes:

- Twaron/Lcp twill T9-1396 against 2 gr in with a V50 of 482 fps
- Twaron Twill T9-1400 V50 of 747 fps

Figure 9

| | | Protective Mid Cover | Protective Mid Cover | Protective Mid Cover | Protective Mid Cover | Protective Mid Cover |
|---|---|---|---|---|---|---|
| | | Jacket | Twill pant | PA twill | PA basket | Liner |
| | | T9-1400 | T9-1396 | T9-1424 | | T9-1408 |
| Construction Analysis | | 8H satin | 4/1 twill | 4/1 twill | 2x1 basket | pw |
| Crossing points | | 0.083 | 0.25 | 0.25 | 0.5 | 1 |
| Warp count | epi | 110 | 110 | 68 | 52 | 110 |
| Warp denier | denier | 200 | 200 | 500 | 410.4 | 200 |
| SG warp | sg | 1.38 | 1.38 | 1.38 | 1.38 | 1.38 |
| | | | | | | |
| Fill count | epi | 50 | 60 | 52 | 54 | 52 |
| Fill denier | denier | 660 | 265 | 410.4 | 410.4 | 200 |
| SG fill | sg | 1.38 | 1.38 | 1.38 | 1.38 | 1.38 |
| | | | | | | |
| Warp diameter | in | 0.0056 | 0.0056 | 0.0081 | 0.0081 | 0.0056 |
| Fill diameter | in | 0.0102 | 0.0065 | 0.0081 | 0.0081 | 0.0056 |
| | | | | | | |
| %of fill in warp | % | 62% | 62% | 55% | 42% | 62% |
| % full in fill | % | 51% | 39% | 42% | 44% | 29% |
| Simple combined cover | % | 113% | 101% | 97% | 86% | 91% |
| Combined cover x crossing points | | 9% | 25% | 24% | 43% | 91% |
| | | | | | | |
| fabric mass | oz/yd2 | 7.71 | 5.32 | 7.56 | 5.94 | 4.42 |

Figure 10

| | | Full Cover | Full Cover | Low-Mid Cover | Low-Mid Cover | Low Cover | Low Cover |
|---|---|---|---|---|---|---|---|
| | | | | | | | |
| | | T9-1263 | T9-1334 | T9-1094 | T9-1398 | T9-1285 | DP 726 |
| Construction Analysis | | pw staple | pw filament | pw staple | oxford staple | pw staple/filament | pw filament |
| Crossing points | | 1 | 1 | 1 | 1 | 1 | 1 |
| Warp count | epi | 110 | 95 | 83 | 50 | 15 | 26 |
| Warp denier | denier | 200 | 220 | 140 | 265 | 840 | 840 |
| SG warp | sg | 1.38 | 1.1 | 1.38 | 1.38 | 1.38 | 1.38 |
| | | | | | | | |
| Fill count | epi | 65 | 78 | 70 | 90 | 15 | 26 |
| Fill denier | denier | 400 | 220 | 140 | 132 | 840 | 840 |
| SG fill | sg | 1.38 | 1.1 | 1.38 | 1.38 | 1.38 | 1.38 |
| | | | | | | | |
| Warp diameter | in | 0.0056 | 0.0066 | 0.0047 | 0.0065 | 0.0115 | 0.0115 |
| Fill diameter | in | 0.0080 | 0.0066 | 0.0047 | 0.0046 | 0.0115 | 0.0115 |
| | | | | | | | |
| %of fill in warp | % | 62% | 63% | 39% | 32% | 17% | 30% |
| % full in fill | % | 52% | 52% | 33% | 41% | 17% | 30% |
| Simple combined cover | % | 114% | 115% | 72% | 74% | 35% | 60% |
| Combined cover x crossing points | | 114% | 115% | 72% | 74% | 35% | 60% |
| | | | | | | | |
| fabric mass | oz/yd2 | 6.84 | 5.51 | 2.92 | 3.43 | 3.58 | 5.74 |

Figure 11

| | | Limit at 200 | Limit at 195 | Limit at 140 |
|---|---|---|---|---|
| | | claim 1 | claim 1 | claim 1 |
| | | | | |
| Construction Analysis | | | | |
| Crossing points | | 1.000 | 1.000 | 1.000 |
| Warp count | epi | 89 | 90 | 107 |
| Warp denier | denier | 200 | 195 | 140 |
| SG warp | sg | 1.38 | 1.38 | 1.38 |
| | | | | |
| Fill count | epi | 54 | 54 | 64 |
| Fill denier | denier | 200 | 195 | 140 |
| SG fill | sg | 1.38 | 1.38 | 1.38 |
| | | | | |
| Warp diameter | in | 0.0056 | 0.0056 | 0.0047 |
| Fill diameter | in | 0.0056 | 0.0056 | 0.0047 |
| | | | | |
| %of fill in warp | % | 50% | 50% | 50% |
| % full in fill | % | 30% | 30% | 30% |
| Simple combined cover | % | 81% | 80% | 81% |
| Combined cover x crossing points | | 81% | 80% | 81% |
| | | | | |
| fabric mass | oz/yd2 | 4.02 | 3.95 | 3.37 |

Figure 12

PROTECTIVE MID-COVER TEXTILES

RELATED APPLICATIONS

This application claims the benefit of U.S. Provisional Application No. 61/779,250, filed Mar. 13, 2013, which is herein incorporated by reference in its entirety for all purposes.

FIELD OF THE INVENTION

The invention relates to protective garments, and more particularly, to flexible protective fabrics used in making protective garments.

BACKGROUND OF THE INVENTION

The variety and types of threats encountered by soldiers in combat, as well as by law enforcement officers and others, continues to expand. Also, it can be difficult to be certain when circumstances are "safe," and when combat may be imminent.

Soldiers have long worn protective armor to offset many kinds of threats, but such armor typically includes thick, rigid panels and is too bulky, heavy, and inflexible to be worn at all times. Moisture transport can also be quite low for such armor, making the armor uncomfortable to wear. As a result, protection is not always worn when it is needed. In addition, such traditional armor solutions tend to be optimized for only one or two types of threat, while soldiers in the field encounter a wide variety of threats that would be better addressed by a more adaptable fabric armor solution.

Current approaches in protective fabrics typically fall into either of two categories. They are either low cover-factor ballistic and cut fabrics that lack durability and abrasion resistance, and therefore have no capacity to be used as an outer layer, or they are high cover fabrics that are designed for puncture and cut resistance. A good example of this second category is the 28 gauge needle resistance fabrics disclosed by Howland in patent number U.S. Pat. No. 5,565,264. This Howland fabric has a warp cover of 62%, a fill cover of 52%, and combined cover at the crossing points of 114%.

What is needed, therefore, is a new class of protective fabric that combines wearable drape and softness with moisture transport, making the new fabrics comfortable to wear as garment fabrics, while also providing good fragment ballistic protection and good abrasion resistance and durability.

SUMMARY OF THE INVENTION

The current invention is a new class of protective fabric that is suitable for making flexible and comfortable protective garment. The invention is based, at least in part, on a realization that when the cover factor of a protective fabric is too high, the yarns will be distorted at the crossing points, and this yarn distortion will increase the stiffness and reduce the bendability of the fabric without significantly increasing its protective properties, at least for many types of threat. This yarn distortion effect was not well understood in the field before the present invention. Accordingly, the fabrics of the present invention have a reduced cover factor that is high enough to provide closed interstices, but is not so high as to cause distortion of the yarns at the crossing points.

In embodiments, the bendability, flexibility, and comfort of the present invention are further improved by using a long-float weave such as a twill or satin. Yet another surprising result of the present invention is that the protection offered by such long-float weaves is not significantly reduced as compared to simple weaves, yet the flexibility and comfort are significantly improved.

The new fabrics of the present invention thereby meet three distinct requirements simultaneously. They have wearable drape, softness, and moisture transport, making them comfortable to wear as garment fabrics. They also provide good fragment ballistic protection. And although they are made from ballistic fiber, they also have good abrasion resistance and durability. This combination of wearability, fragment resistance, and durability is unique to the present invention.

The textile of the present invention is woven from yarns comprising at least 20% ballistic fibers having tenacity greater than 12 gpd. At least some of the yarns have a denier greater than 199. Embodiments have a long-float weave pattern with a correspondingly reduced crossing point density, such as a twill or satin weave, so as to improve drape and wearability, and a combined cover factor between 55% and 80% so as to provide vanishingly small interstices without packing or distorting the yarns. As explained in more detail below, we have found it helpful to characterize protective fabrics according to a metric we call the "SCCF×CCD" that is the product of the simple combined cover factor and the crossing point density. The SCCF×CCD for the present invention is less than 100%, and in embodiments is between 10% and 40%. The use of ballistic fibers with high cover factor provides good fragment protection, while the long-float weave pattern provides good drape and flexibility.

The combination of performance features provided by the present invention was a surprising result, because the generally accepted wisdom in the art at the time of the invention was that fabrics made from ballistic fiber were known to have poor abrasion and durability in outer layer applications. Moreover, such protective fabrics hand, and were not used for garments, especially not for garments that made contact with a user's skin. Flying in the face of this generally accepted wisdom, the present invention combines ballistic fibers with a mid-range cover density, and in embodiments also with a long-float weave pattern such as twill or satin, to provide a textile that is both wearable and durable, while also providing a fragment V50 performance to weight ratio that is similar to fabrics designed only for their fragment resistance.

The success of twill, satin, and other long float weaves in the present invention was also surprising. As expected, the long floats in these weaves improve the hand and drape of the fabric. However, it was surprising that the long floats did not have a negative impact on abrasion or fragment performance of the fabrics. The combination of long floats, high strength yarns, and staple yarns mixed with filaments at the right mid-cover factor provides a family of unique and novel fabrics.

Crossing Points

The density of crossing points in a weave affects many characteristics of the fabric, including stiffness, abrasion, and cut resistance. Accordingly, the simple combined cover factor can only be used to compare fabrics that have the same crossing point density. However, in some embodiments the mid-cover fabrics of the present invention make significant use of long weave floats instead of plain weaves. In order to compare effective cover factors for different weave types, we have found it useful to use a metric whereby the crossing point density for a long-float weave, divided by the crossing point density of a plain weave, is multiplied times the simple combined cover factor. As discussed below in more detail with reference to FIG. 8, a unit weave cell is selected to compare the crossing point density of various weaves. This unit cell must be large enough for the most complex weave with the largest unit cell.

In embodiments, according to circular bending tests and garment tests, the product (SCCF×CPD) of the simple combined cover factor ("SCCF") and the crossing point density ("CPD"), expressed as a percentage of a simple weave fabric, is less than 100% for mid-cover fabrics in the lower fabric mass range. For similar embodiments in the center range of mass, the SCCF×CPD is less than 40%, even when the SCCF is well about 80%. This is accomplished by reducing the CPD to 50% or less in these fabrics.

Staple Yarn Predominantly on the Wear Face of the Fabric

In some embodiments a long-float weave pattern such as a twill or satin is utilized both to reduce the crossing point density and thereby improve the hand of the fabric, and also so that the fabric will have a different character on each face. When staple yarns are used in one yarn direction and filament yarns are used in the other yarn direction a floated weave pattern will result in a predominantly staple fabric face and a predominantly filament fabric face. The ratio of crossing points to the plain weave crossing point density is also a measure of the differentiation of the two sides of the fabric. In some embodiments good staple-filament differentiation is found at crossing point densities of less than 50% of a plain weave. Protective garments constructed such that the predominantly staple fabric face is in contact with skin of a user will thereby provide better wearing comfort than similar garments having a plain weave.

One general aspect of the present invention is a protective fabric that includes a fabric woven from yarns, each of the yarns including at least one fiber, at least 20% of the fibers being protective fibers having tenacities greater than 12 gpd, the fabric having a simple combined cover factor of between 55% and 80%, and a product of the simple combined cover factor and a normalized crossing point density of the protective fabric, referred to herein as the "SCCF×CPD," being less than 100%, where the normalized crossing point density is a ratio of a crossing point density of the protective fabric divided by a crossing point density of a plain weave fabric woven with a yarn denier and simple cover factor equal to those of the protective fabric.

In embodiments, a first cover factor in a first yarn direction is greater than 50% and a second cover factor in a second yarn direction is greater than 30%. In some embodiments the fabric has a V50 for 2 gr RCC fragment of greater than 350 fps for a single ply, as measured using Mil Std test method 662F. In other embodiments at least some of the yarns have a denier greater than 199.

In various embodiments the SCCF×CPD is between 10% and 40%. In certain embodiments, the fabric is woven with a twill or satin weave.

In embodiments, the protective fibers include at least one of para-aramid and liquid crystal polyester ("LCP") fibers. Some embodiments further include a primer coating greater than 3% by weight, the primer covering substantially all surfaces of all fibers in the fabric.

In various embodiments, the coating provides at least one of UV protection, abrasion protection, and color acceptance. And in certain embodiments the Frazier ASTM permeability of the protective fabric is between 5 and 60 cfm/ft2.

Another general aspect of the present invention is a protective fabric that includes a fabric woven from yarns, each of the yarns including at least one fiber, the fabric having a predominantly staple fiber face and a predominantly filament fiber face, the fabric having a normalized crossing point density of greater than 65%, the fabric having a fabric mass between 95g/yd2 and 450 g/yd2, and at least 20% of the fiber being protective fiber with greater than 12 gpd tenacity.

In embodiments, at least some of the yarns have a denier of great then 140. In some embodiments the permeability of the fabric as measured using a Frazier differential-pressure air permeability tester is less than 60 cfm/ft2.

In various embodiments, the fabric has a V50 for 2 gr RCC fragment of greater than 350 fps for a single ply, as measured using Mil Std test method 662F. In certain embodiments, the fabric is woven with a twill or satin weave.

In some embodiments, the protective fibers include at least one of para-aramid and liquid crystal polyester ("LCP") fibers. Other embodiments further include a primer coating greater than 3% by weight, the primer covering substantially all surfaces of all fibers in the fabric.

In embodiments, the coating provides at least one of UV protection, abrasion protection, and color acceptance. And in some embodiments the Frazier ASTM permeability of the protective fabric is less than 60 cfm/ft2.

Still another general aspect of the present invention is a protective fabric that includes a fabric woven from yarns, each of the yarns including at least one fiber, the fabric having a circular bend of between one and ten lbs, at least 20% of the fibers being greater than 12 gpd, and the fabric having a fabric mass greater than 95 g/yd2.

In embodiments, the fabric has a textile construction having less than 90% of available crossing points. In some embodiments the fabric has a permeability of less than 60 cfm/ft2, as measured using a Frazier differential-pressure air permeability tester. In other embodiments the fabric has a Ref of less than 15 units, as measured according to ASTM standards using a sweating guarded hotplate.

In various embodiments the fabric has a V50 for 2 gr RCC fragment of greater than 350 fps for a single ply as measured using Mil Std test method 662F. In certain embodiments the fabric is woven with a twill or satin weave.

In embodiments, the protective fibers include at least one of para-aramid and liquid crystal polyester ("LCP") fibers. Some embodiments further include a primer coating greater than 3% by weight, the primer covering substantially all surfaces of all fibers in the fabric.

In other embodiments, the coating provides at least one of UV protection, abrasion protection, and color acceptance. And in various embodiments the Frazier ASTM permeability of the protective fabric is less than 30 cfm/ft2.

Still another general aspect of the present invention is a protective fabric that includes a fabric woven from yarns, each of the yarns including at least one fiber, the fabric having abrasion resistance greater than 5,000 cycles against 400 grit using Martindale abrasion method, at least 20% of the fiber having a tenacity greater than 12 gpd, and the fabric having a fabric mass between 95g/yd2 and 450 g/yd2. Embodiments further include a protective coating that is greater than 3% by weight. In some embodiments, the Tensile Property loss of the fabric after 25 AATCC standard washings is less than 10%. In other embodiments the fabric has a UV exposure tensile loss of less than 15% when exposed to AATCC.

In certain embodiments, the fabric has an ASTM vertical flame consumption of less than 50%. In various embodiments the fabric has an EN388/ANSI 150 puncture greater than 3.

In embodiments, the fabric has a V50 for 2 gr RCC fragment of greater than 350 fps for a single ply as measured using Mil Std test method 662F. In some embodiments, the fabric is woven with a twill or satin weave. In various embodiments, the protective fibers include at least one of para-aramid and liquid crystal polyester ("LCP") fibers.

Certain embodiments further include a primer coating greater than 3% by weight, the primer covering substantially all surfaces of all fibers in the fabric. In some embodiments, the coating provides at least one of UV protection, abrasion protection, and color acceptance. And in some embodiments the Frazier ASTM permeability of the protective fabric is less than 30 cfm/ft2.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 8 illustrates crossing point patterns and compares the ratios of crossing point densities for a plain weave, a 2/2 twill, a 3/3 twill, and a 5 Harness satin of the present invention;

FIG. 9 is a table that presents representative fragmentation results for embodiments of the present invention;

FIG. 10 is a table that presents fabric hand data obtained using AATCC Procedure #5;

FIG. 11 is a table that presents a comparison of features for various full cover, low-mid-cover and low cover fabrics;

FIG. 12 is a table that presents minimum yarn sizes and fabric masses for embodiments of the present invention.

DETAILED DESCRIPTION

Yarns

In embodiments, the yarns required to produce the present mid-cover invention are 70 denier (70/1 cc) or larger. From a yarn production perspective, the lower limit on para-aramid yarns is 70 denier in the form of 70/2 cc. For abrasion durability and protection, either filament yarns or 2-ply staple yarns are preferred.

Cover Factor

The Cover Factor used to define the present invention is based on calculation of the yarn diameter based on the denier, the specific gravity, and the assumption that the diameter of a round cross section monofilament will remain constant regardless of the number of filaments in a multi filament yarn. This simplifying monofilament treatment avoids any assumptions about multifilament yarn bundle cross section shape. All warp and fill yarn cover calculations use this same calculation of diameter.

The protective fabrics of the present invention can be described as having mid-range cover factors. There are full cover fabrics in the prior art that have maximum practical cover factors, such as in the Howland '264 patent. The mid-cover fabrics of the present invention have a range of cover factors from 25 to 65% in each yarn direction, so that the simple combined cover in both yarn directions is greater than 80%. The simple combined cover factor is the sum of the monofilament cover factors in each of the 2 yarn directions. For production efficiency, the warp direction typically has the higher cover factor, with embodiments exceeding 50% warp cover, and some embodiments exceeding 60%. These higher cover factors are facilitated in various embodiments by using weave designs that float yarns and reduce the number of crossing points. Twills and satin weaves are typical examples of this type of float yarn construction.

Figure 1A:
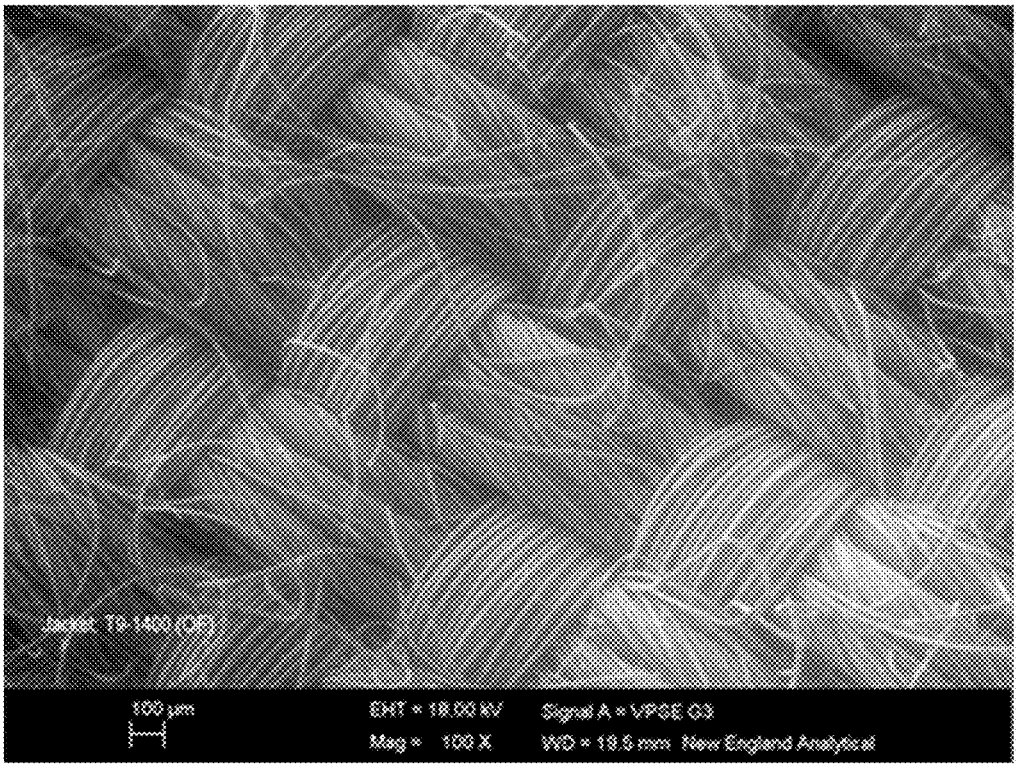
FIG. 1A is a 100× magnified image of the face of an 8 Harness satin in an embodiment of the present invention.
Figure 1B:
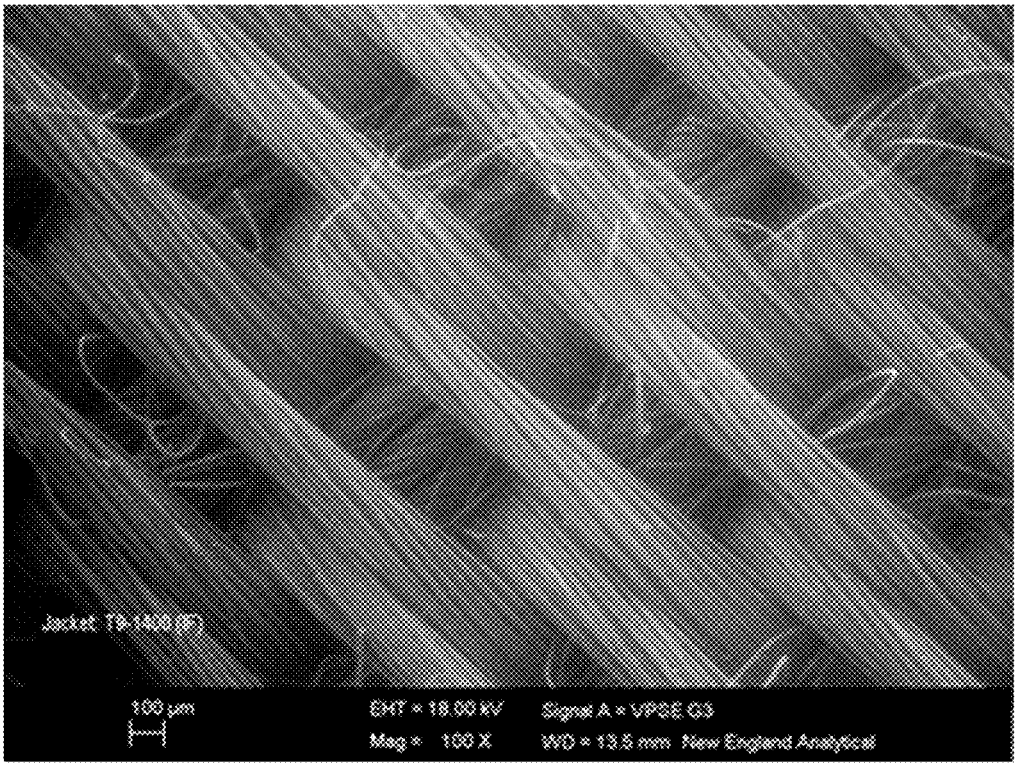
FIG. 1B is a 100× magnified image of the back or non-wear side of a 10 Harness satin fabric showing a filament-dominated face.
Figure 2A:
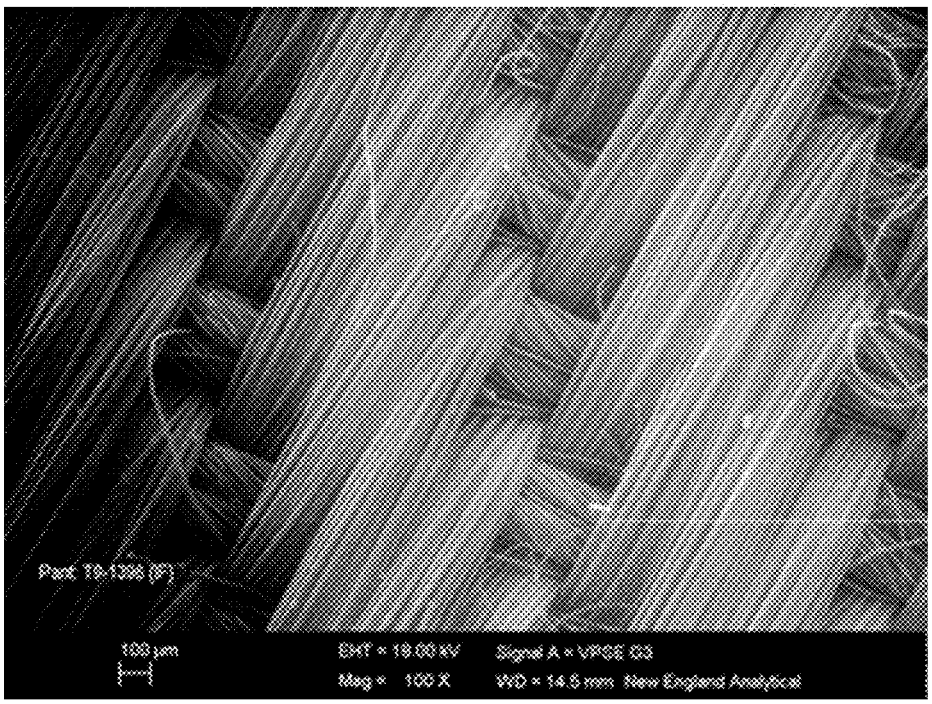
FIGS. 2A and 2B are 100× magnified images of the filament face and staple face respectively of a twill in an embodiment of the present invention.
Figure 2B:
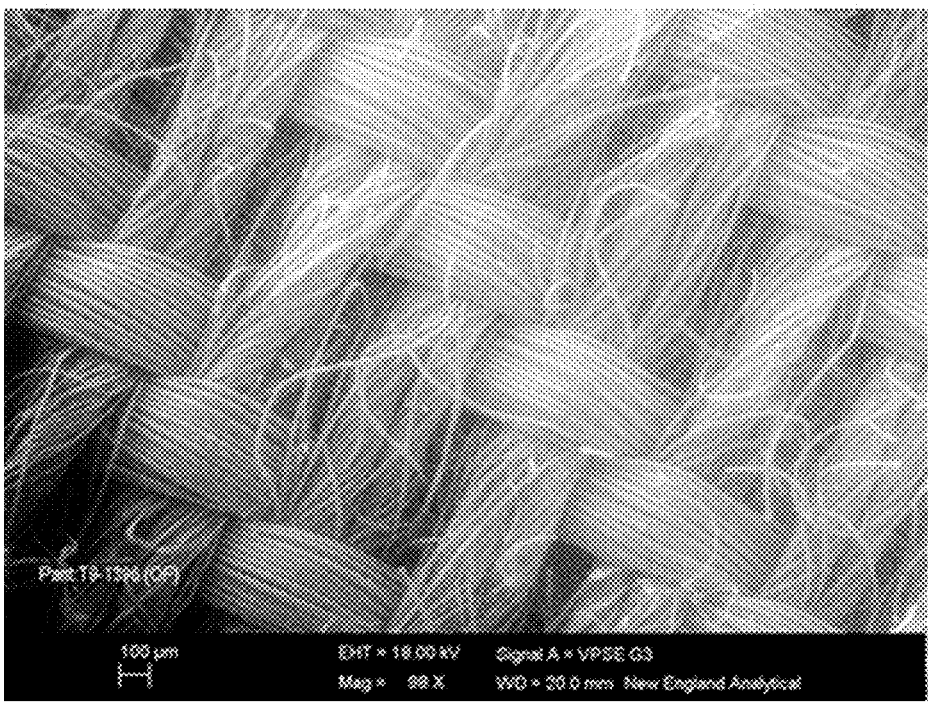

FIGS. 1A and 1B present 100× magnified images of the face of an 8 Harness satin of the present invention and the back or non-wear side of a 10 Harness satin fabric of the present invention, showing a filament-dominated face. FIGS. 2A and 2B are 100× magnified images of the filament face and staple face respectively of a twill in an embodiment of the present invention. These twill and satin micrographs show the representative cover ratios and the lack of open interstices in these designs. They also show the mixed filament and staple character of embodiments of the present invention. Furthermore, they are both examples of how the floats in the weave design are integral to the development of the system. In embodiments, the drape or softness is controlled by the use of floats in the construction.

Figure 3:
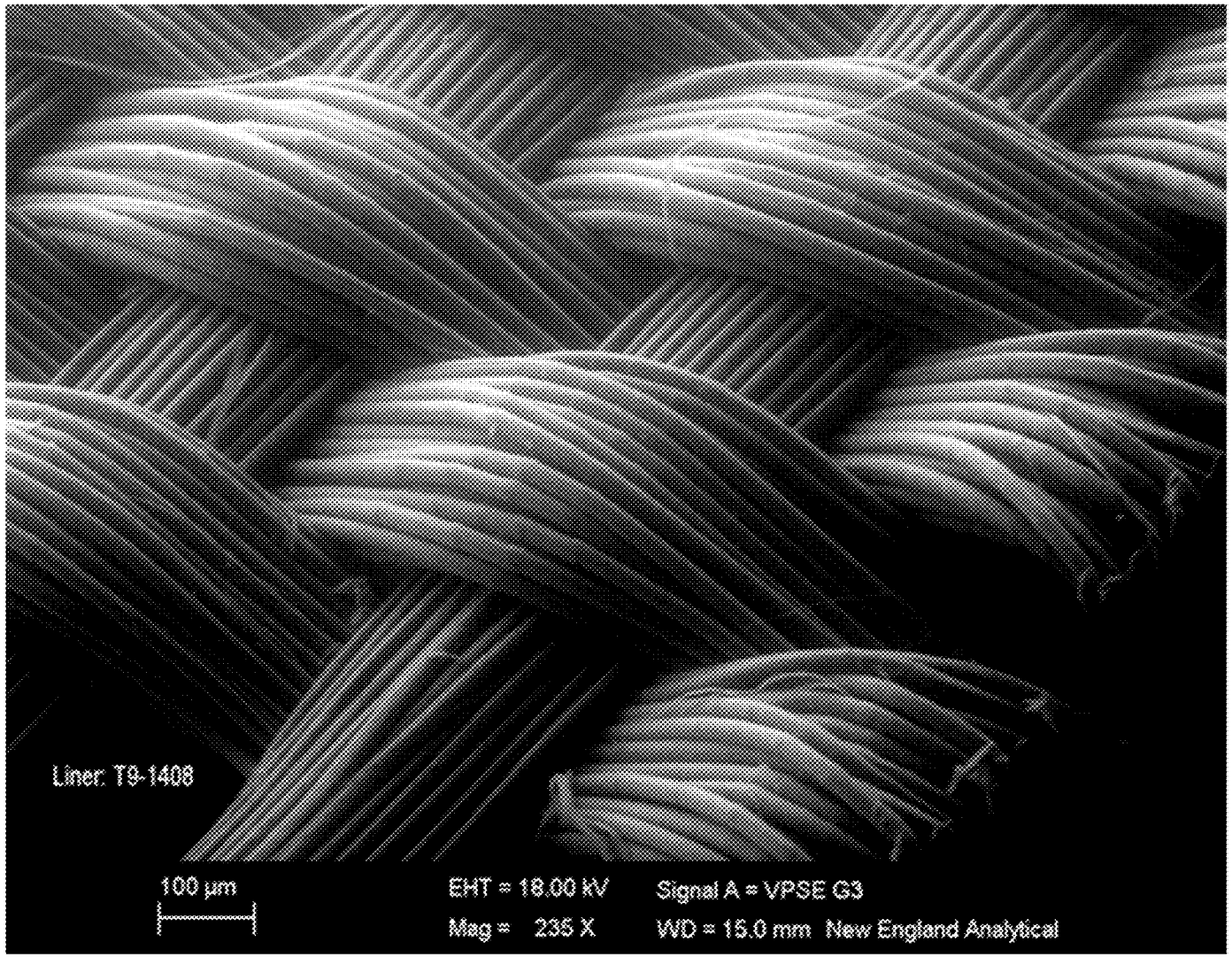
FIG. 3 is a 235× magnified image of a 200d LCP protective plain weave mid-cover fabric that meets the lower cover limit of the present invention performance for softness, durability and protection in an embodiment of the present invention.
Figure 4:
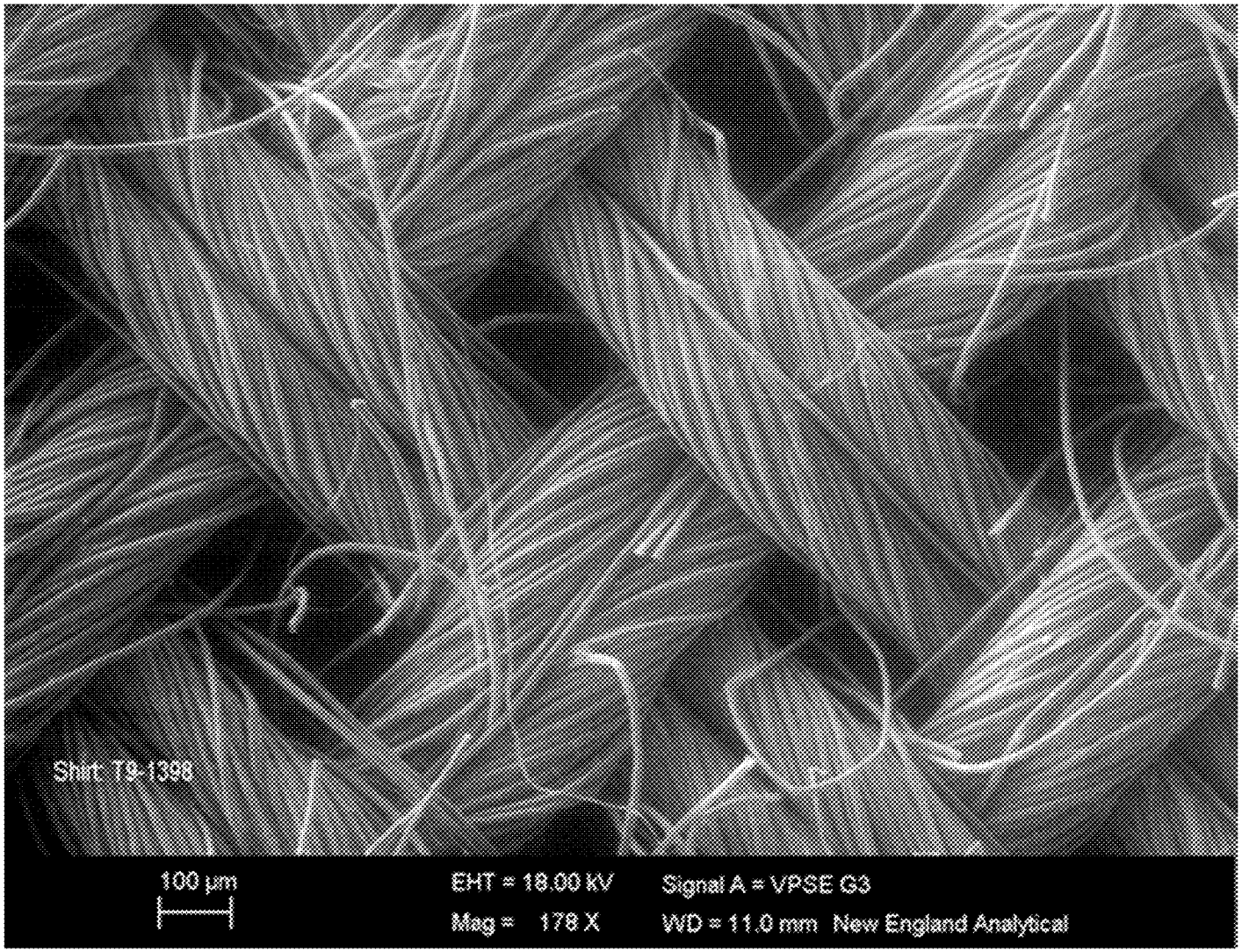
FIG. 4 is a 178× magnified image of an oxford cloth that falls below the minimum cover factor and minimum durability of the present invention.

FIG. 3 is a 235× magnified image of a 200 d LCP protective plain weave mid-cover fabric plain weave that meets the lower cover limit of the present invention. Note in these figures that there are minimal or no openings at the interstices. Even for embodiments having floats that are 12 yarns in length, the interstices are not open. This requirement sets a lower limit for the cover factor of the invention, in that the mid-cover fabrics of the present invention are characterized by closed interstices without distortion of the yarns at the crossing points. By contrast, FIG. 4 is a 178× magnified image of an oxford cloth that falls below the minimum cover factor and minimum durability of the present invention. In this oxford construction the interstice size of low-mid cover fabrics is evident. Low-mid weaves are still competent fabrics, but do not have enough cover to be fully protective, and lack durability.

Figure 5:
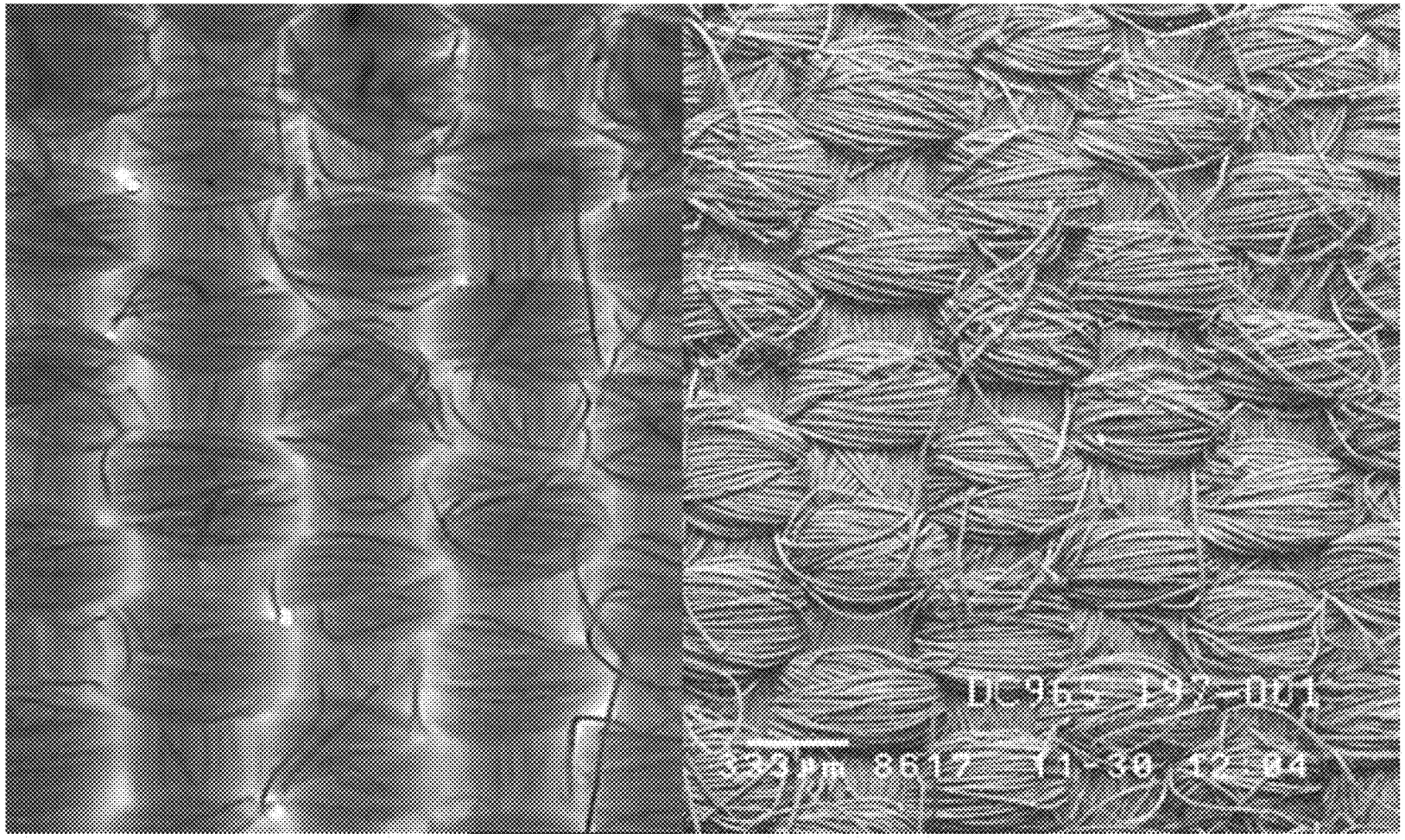
FIG. 5 presents 30× magnified images of a protective full cover plain weave staple fabric that exceeds the maximum cover factor limit of the present invention.
Figure 6:
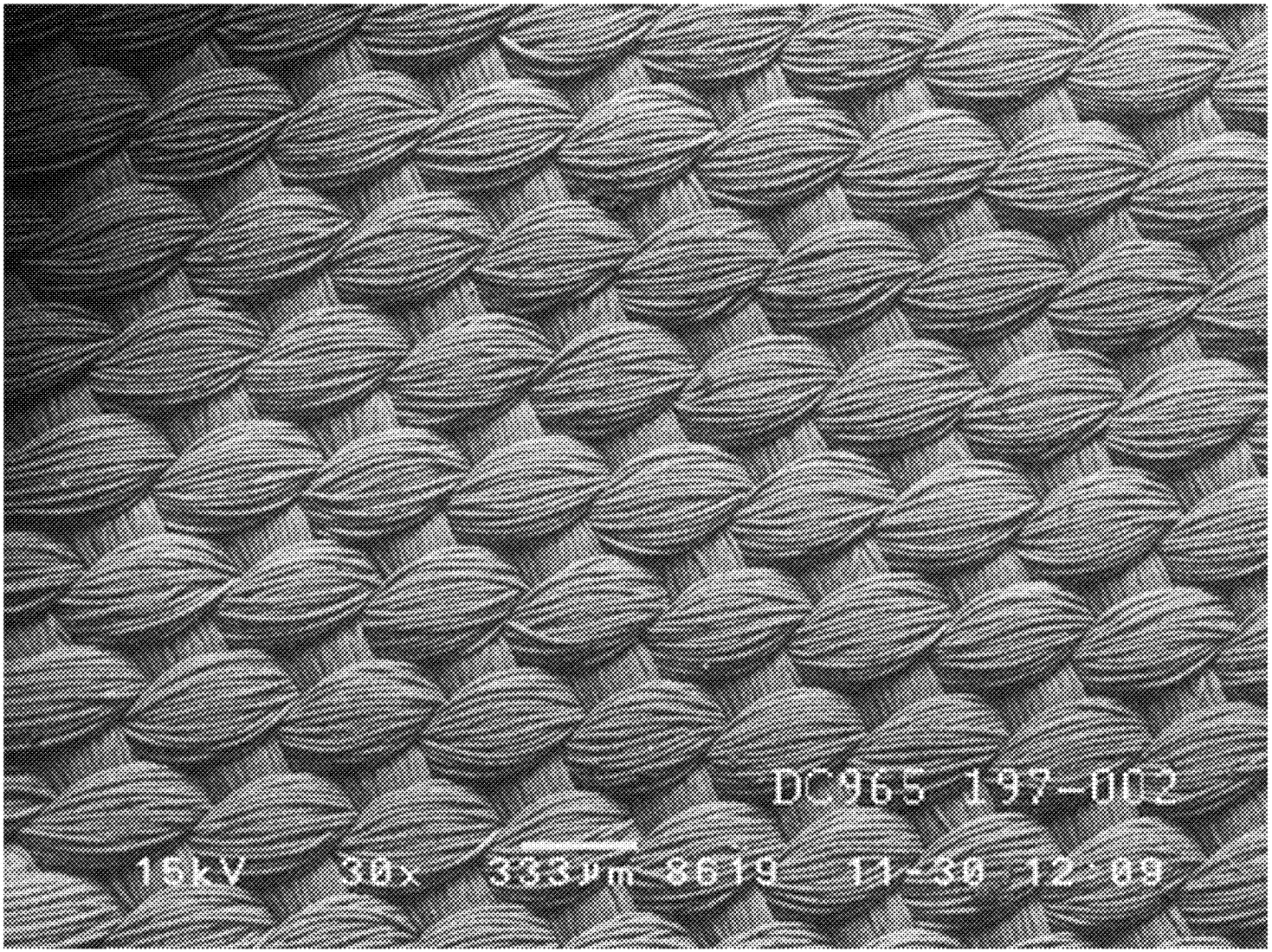
FIG. 6 is a 30× magnified image of a protective filament full cover fabric that exceeds the maximum cover factor of the present invention.
Figure 7A:
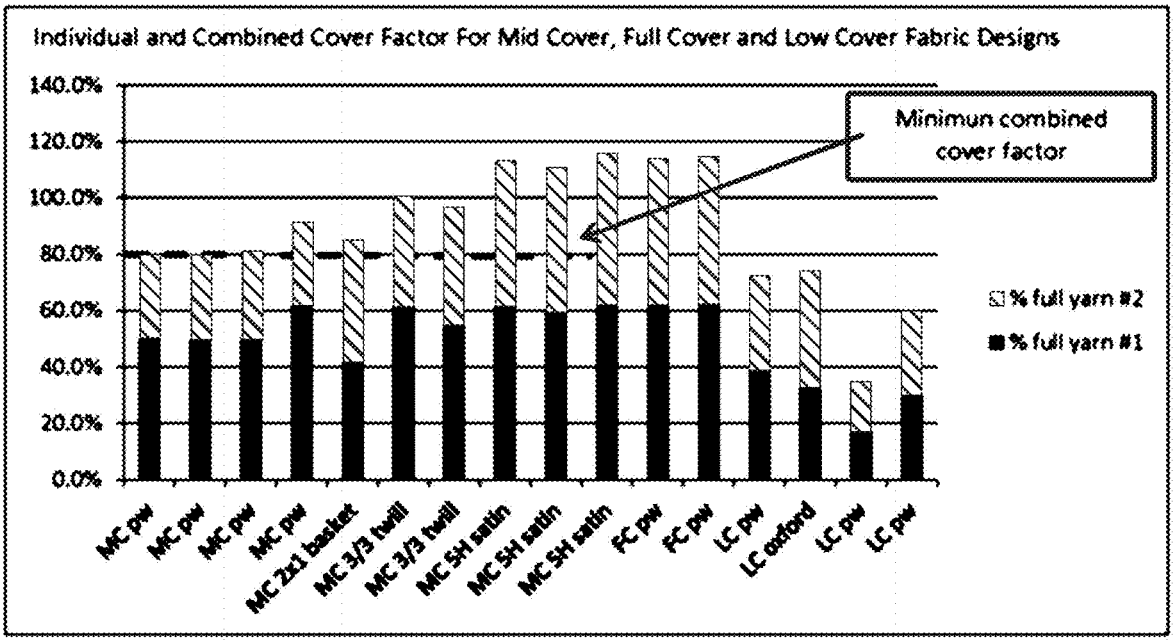
FIG. 7A is a bar graph that compares individual and combined cover factors for the mid-cover protective fabrics of the present invention with low-cover and full-cover protective fabrics.
Figure 7B:
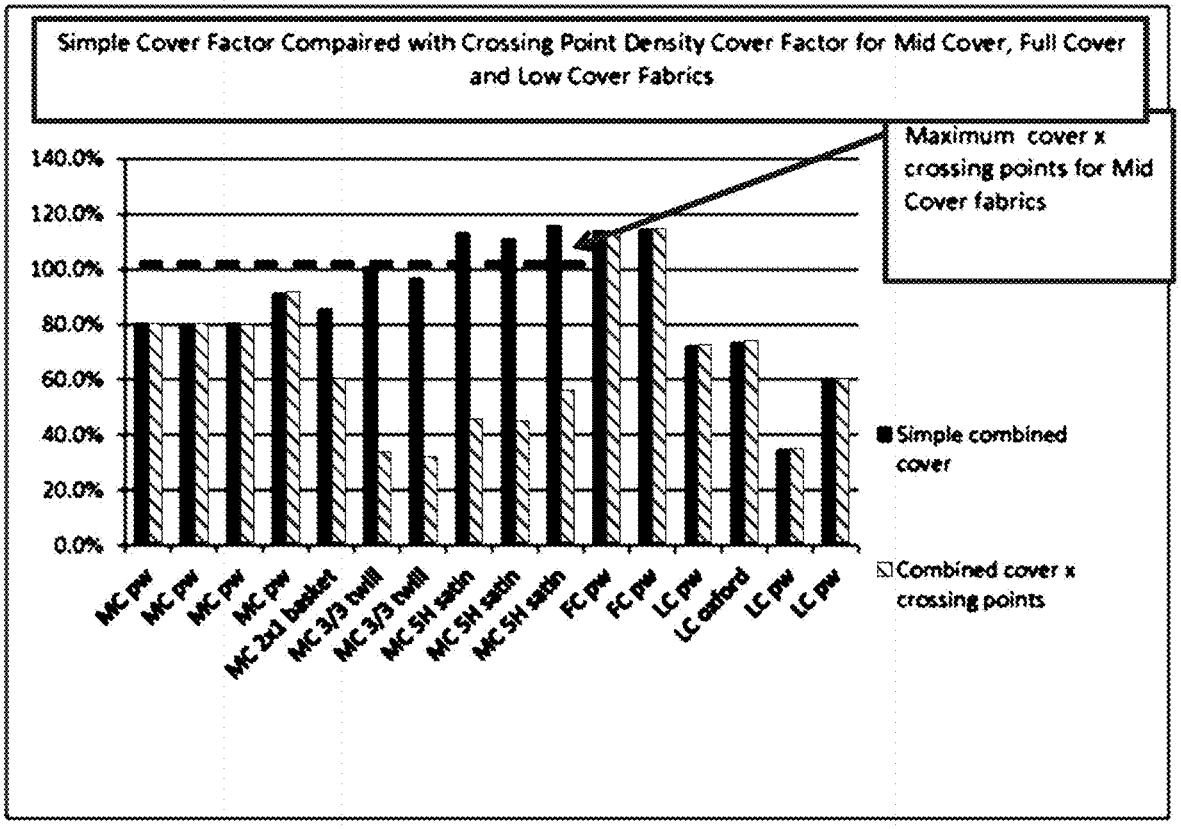
FIG. 7B is a bar graph that compares simple cover factors with the crossing point density cover factors for the mid-cover protective fabrics of the present invention and for low-cover and full-cover protective fabrics.

On the other hand, because the novelty of the present invention lies in a combination of protection, softness, and durability, the simple cover factor must be limited if there are no floats in the weave. As the cover factor is increased, the packing of the yarns must increase. Eventually, the yarns will become over-packed, especially at the crossing points, and will distort. This is illustrated in FIGS. 5 and 6, which present 30× magnified images of protective full-cover plain weave staple fabrics that exceed the maximum cover factor limit of the present invention. Even in the optical micrograph on the left of FIG. 5 it can be see that the over-packed structure of full cover fabrics compresses the fiber into the interstices. Note the distortion of the yarn shape as they exit the crossing points.

As can be seen in FIGS. 5 and 6, in a full cover plain weave fabric the yarn becomes packed tightly enough to begin to distort at the crossing points. This distortion effect leads to increased stiffness, and sets an upper limit on the cover factor range of the present invention, because designs that are packed so tightly as to distort the yarns at the crossing points are not sufficiently soft as measured by circular bending. The mid cover fabric construction of the present invention provides for protection from fragments without the loss of mobility and softness that would result from full cover packing and the resultant yarn distortion.

Crossing Points

The density of crossing points in a weave affects many characteristics of the fabric, including stiffness, abrasion, and cut resistance. Accordingly, the simple combined cover factor can only be used to compare fabrics that have the same crossing point density. In embodiments, the mid-cover fabrics of the present invention make significant use of long weave floats, and some embodiments are not plain weaves. In order to compare effective cover factors for different weave types, we have found it useful to use a metric referred to as the "SCCF×CPD," whereby the crossing point density (CPD) for a long-float weave, divided by the crossing point density of a plain weave, is multiplied times the simple combined cover factor (SCCF). With reference to FIG. 8, a unit weave cell is selected to compare the crossing point density of various weaves. This unit cell must be large enough for the most complex weave with the largest unit cell. For example, the 5 Harness satin illustrated in FIG. 8 required a 6×6 unit cell, and all the other weaves were drafted using this unit cell. The transitions are counted in both warp and fill and summed for each weave. The percentage of each of the weaves relative to the plain weave is calculated for each.

In embodiments, according to circular bending tests and garment tests, the product of the simple combined cover factor ("SCCF") and the crossing point density ("CPD") expressed as a percentage of a simple weave fabric ("SCCF×CPD"), is less than 100% for mid-cover fabrics in the lower fabric mass range. For similar embodiments in the center range of mass, the SCCF×CPD is less than 40%, even when the SCCF is well about 80%. This is accomplished by reducing the CPD to 50% or less in these fabrics.

Representative Fragmentation Performance

FIG. 9 is a table that presents representative fragmentation results for embodiments of the present invention. When combined into a garment with liners and additional underlayers, it is possible to achieve 16 gr fragment resistance in the 1000-1300 fps range. This is the result of multiple layers of the midcover fabrics and mid to low cover fabrics of the present invention. However, it illustrates how much protection can be achieved with mid cover materials in garment applications.

Resultant Circular Bending and Softness

The balance of performance required for mid-cover fabrics includes the need for softness. Full Cover fabrics provide sufficient abrasion resistance and protection, but they are not flexible or soft enough for many garment applications. The mid-cover fabrics of the present invention are characterized by a "soft hand," both by subjective evaluation and per AATCC Procedure #5 Fabric Hand: *Guidelines for the Evaluation* and objective evaluation per ASTM D4032-08(2012) *Standard Test Method for Stiffness of Fabric by the Circular Bend Procedure.*

Representative circular bend results are:

T9-1396 Pant twill 2.24 lbf

T9-1424 SPS twill 3.7 lbf

T9-1400 Jacket 5.25 lbf

All of these results represent acceptable fabric softness for garment applications. Embodiments of the present invention run at the high end of the range of circular bending, as a result of the compromise in the need for penetration performance and abrasion resistance.

FIG. 10 is a table that presents fabric hand data obtained using AATCC Procedure #5. FIG. 11 is a table that presents a comparison of features for various full cover, low-mid-cover and low cover fabrics.

High cover fabrics have protective and durability but lack the softness of mid-cover fabrics. Low-cover fabrics lack the durability of mid-cover fabrics in demanding outer wear garment applications.

Minimum Mid-Cover Fabric Mass

FIG. 12 is a table that presents minimum yarn sizes and fabric masses for durable mid cover fabrics. There is a practical lower limit on the size of protective yarns containing LCP Vectran, Para Aramid Kevlar-Twaron-Technora etc, Meta Aramid Nomex Conex etc, UHMWPE Dynemma-Spectra, or PBO Xylon. In most cases, practical yarns are larger than 70 denier or 70/1 cc. For durability, the mid-cover fabrics of the present invention are made from filament yarns of greater than 140 denier, or from 2 ply staple yarns greater than 70/2 denier, or a combination of both staple and filament yarns. This effective lower limit, combined with the required cover factors, sets a lower limit on the fabric mass of a mid-cover fabric of approximately 95 g/yd2. It is difficult to define an upper bound on protective yarn size. In practice approximately 1500 denier may be used as the upper limit of the yarn denier. A mid-cover fabric can be created using this yarn size and a reduced CPD of approximately 450 g/yd2. The protection of this fabric per ply is good, as is its abrasion resistance. However a 15 oz/yd2 fabric is too stiff and has poor thermal behavior in garments. In many garment configurations, 2 or more plies of a lighter mid-cover design according to the present invention can be used in areas requiring high protection or abrasion resistance. Such multi-ply solutions improve flexibility.

Figure 13:
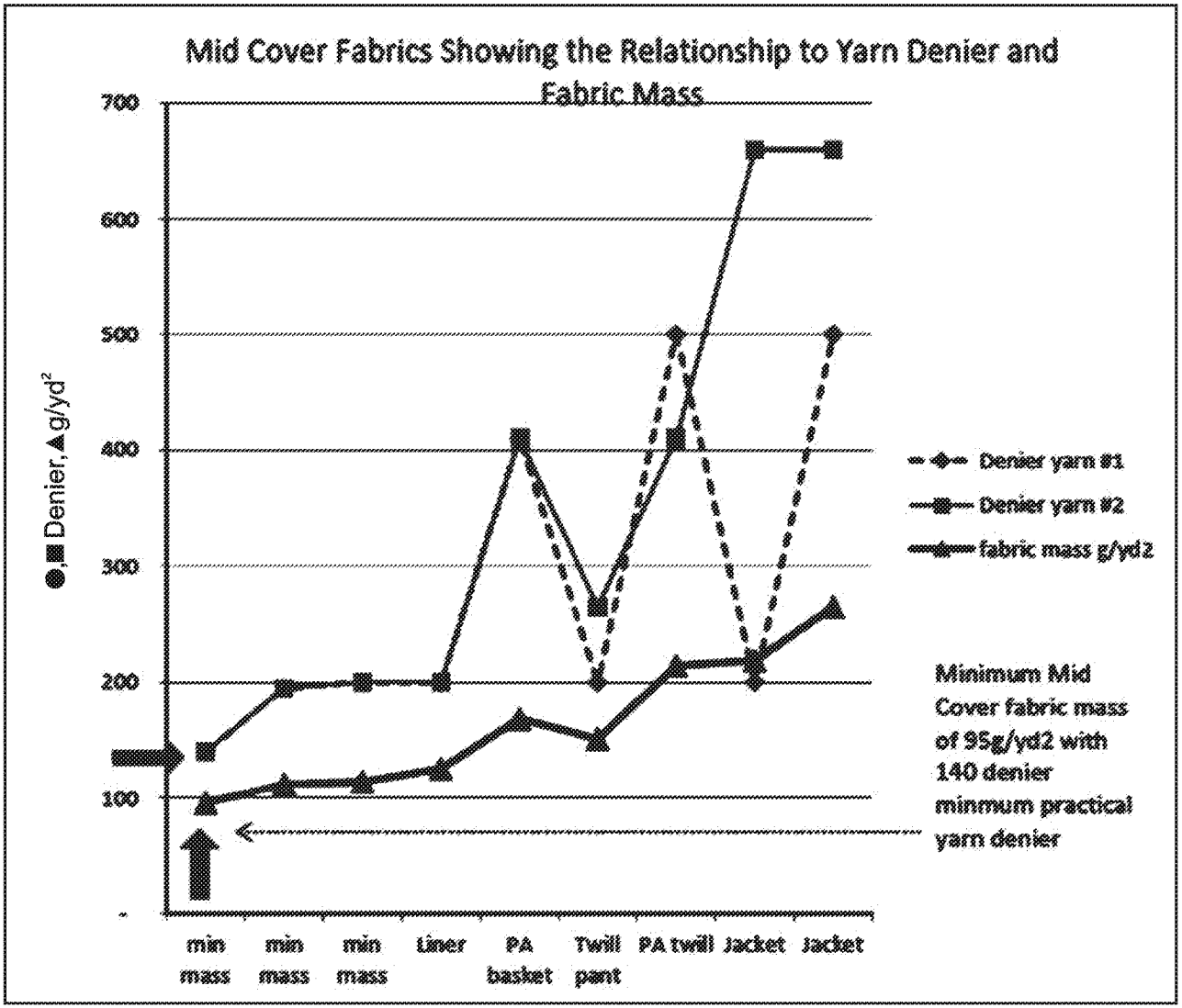
FIG. 13 is a graph that shows the relationship between yarn denier and fabric mass for various embodiments of the present invention.

FIG. 13 is a graph that presents the relationship between yarn density and fabric mass for various embodiments of the present invention.

Coatings for Durability

Some embodiments of the present invention include Para Aramid fibers, while other embodiments include other fiber types according to the requirements of the application. Blending Para Aramid is also effective in applications. In embodiments, Para Aramid or another protective fiber may have insufficient resistance to chemical, abrasive or UV degradation, or to a combination of these factors. In some of these embodiments a coating is applied to the fiber to improve its resistance to such attacks. The type of protection that is required defines the coating type. In many embodiments, acrylic, urethane, neoprene, nitrile, or silicone emulsions or solvent solutions are used. These coating resins can produce soft, thin deposits that have very limited impact on the stiffness of the fabric. These resins can be modified with fillers and additives as required to improve the resistance of the fabric to attack. A typical add-on for a resin-filler system is 0.5-2.5% of the fabric weight.

With reference to FIG. 8, in testing and comparison it was found that a 5 harness satin required a 6×6 unit cell. Accordingly, all of the other weaves were drafted using this same unit cell. The transitions are counted in the figure in both warp and fill, and summed for each weave. The crossing point percent of each of the weaves relative to the plain weave is calculated for each.

Representative Abrasion Performance

Following are abrasion behavior Martindale results for durability in embodiments of the present invention:

T9-1396 Pant twill 6042 cycles on 400 grit

T9-1424 SPS twill 9000 cycles on 400 grit

T9-1400 Jacket 7181 cycles on 400 grit

All these results represent good durability results and will support long wearing and good garment life.

Representative Moisture Permeability Performance

Following are Perm-Ref range results for embodiments of the present invention, which has a direct effect on the comfort of the fabrics T9-1396 Pant twill 5.12 REF (Pa*m2/W)

T9-1398 oxford 3.59 REF (Pa*m2/W)

T9-1400 Jacket 5.68 REF (Pa*m2/W)

The resistance of a fabric to moisture vapor transmission at 35 C skin temperature is a very sensitive measure of the textile's ability to support evaporative cooling at the skin of a user in hot weather. The values of REF in the 3 to 6 range for the present invention are typical of the REF values of conventional uniform and work garment fabrics, and support comfortable wear even in a hot climate.

Note that the following test methods are included by reference:

ASTM

1 Circular bending

2 Fabric mass

3 End count

4 Martindale Abrasion

5 Fiber tenacity

6 Textile tensile

7 Vertical flame

8 Cut testing 1790

AATCC

1 Solar exposure

2 Standard wash test

3 Procedure #5 subjective determination of fabric hand

EN

EN388 puncture

Mil Standards

Ballistic testing 662f

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A single ply of a protective fabric suitable for making a protective garment, the single ply being a woven ply, the single ply comprising:

a first plurality of yarns directed in a first yarn direction of the woven ply and a second plurality of yarns directed in an intersecting second yarn direction of the woven ply, all of the yarns of the single ply that are directed in the first yarn direction being staple yarns, and all of the yarns of the single ply that are directed in the second direction being filament yarns, each of the staple and filament yarns including at least one fiber, at least 20% of the fibers by weight of the total of all fibers present in each of the staple and filament yarns of the single ply being protective fibers having tenacities greater than 12 grams per denier ("gpd");

the single ply having a V50 for 2 gr RCC fragment of greater than 350 feet per second ("fps"), as measured using Mil Std test method 662F;

the single ply having a simple combined cover factor of greater than 80%, where the simple combined cover factor is defined as the arithmetic sum of a simple cover factor of the yarns in the first yarn direction and a simple cover factor of the yarns in the second yarn direction; and a product of the simple combined cover factor and a normalized crossing point density of the single ply, referred to herein as the "SCCF×CPD," being less than 100%, where the normalized crossing point density is a ratio of a crossing point density of the single ply divided by a crossing point density of a plain weave fabric ply woven with a yarn denier and simple cover factor equal to those of the single ply.

2. The single ply of claim 1, wherein a warp cover factor of the yarns is greater than 50% and a fill cover factor of the yarns is greater than 30%; whereby the warp cover factor applies to one of the first and second yarn directions and the fill cover factor applies to the other of the first and second yarn directions.

3. The single ply of claim 1, wherein at least some of the yarns of the single ply have a denier greater than 199.

4. The single ply of claim 1, wherein the SCCF×CPD of the single ply is between 10% and 40%.

5. The single ply of claim 1, wherein the single ply is woven with a twill or satin weave.

6. The single ply of claim 1, wherein the protective fibers of the single ply include para-aramid and/or liquid crystal polyester ("LCP") fibers.

7. The single ply of claim 1, wherein the single ply further includes a primer coating representing greater than 3% by weight of the protective fabric, the primer covering substantially all surfaces of all fibers in the single ply.

8. The single ply of claim 7, wherein the coating provides UV protection, abrasion protection, and/or color acceptance.

9. The single ply of claim 1, wherein the Frazier ASTM permeability of the single ply is between 5 and 60 cfm/ft2.

10. A single ply of a protective fabric suitable for making a protective garment, the single ply comprising:

a first plurality of yarns directed in a first yarn direction and a second plurality of yarns directed in an intersecting second yarn direction, all of the yarns of the single ply that are directed in the first yarn direction being staple yarns, and all of the yarns of the single ply that are directed in the second direction being filament yarns, each of the staple and filament yarns including at least one fiber, the single ply being woven in a floated weave pattern such that the single ply has a predominantly staple fiber face and a predominantly filament fiber face, the single ply having a normalized crossing point density of greater than 65%, the single ply having a fabric mass between 3.35 oz/yd2 and 15.9 oz/yd2, and at least 20% of the fibers by weight of the total of all fibers present in each of the staple and filament yarns of the single ply being protective fibers with greater than 12 gpd tenacity.

11. The single ply of claim 10, wherein at least some of the yarns of the single ply have a denier of great then 140.

12. The single ply of claim 10, wherein the permeability of the single ply as measured using a Frazier differential-pressure air permeability tester is less than 60 cfm/ft2.

13. The single ply of claim 10, wherein the single ply has a V50 for 2 gr RCC fragment of greater than 350 feet per second ("fps"), as measured using Mil Std test method 662F.

14. The single ply of claim 10, wherein the single ply is woven with a twill weave.

15. The single ply of claim 10, wherein the protective fibers of the single ply include para-aramid and/or liquid crystal polyester ("LCP") fibers.

16. The single ply of claim 15, wherein the single ply further includes a primer coating representing greater than 3% by weight of the single ply, the primer covering substantially all surfaces of all fibers in the single ply.

17. The single ply of claim 16, wherein the coating provides UV protection, abrasion protection, and/or color acceptance.

18. The single ply of claim 10, wherein the Frazier ASTM permeability of the single ply is between 5 and 60 cfm/ft2.

19. A single ply of a protective fabric suitable for making a protective garment, the single ply being a woven ply, the single ply comprising:

a first plurality of yarns directed in a first yarn direction of the woven ply and a second plurality of yarns directed in an intersecting second yarn direction of the woven ply, all of the yarns of the single ply that are directed in the first yarn direction being staple yarns, and all of the yarns of the single ply that are directed in the second direction being filament yarns, each of the staple and filament yarns including at least one fiber, the single ply having a V50 for 2 gr RCC fragment of greater than 350 feet per second ("fps"), as measured using Mil Std test method 662F, the single ply having a simple combined cover factor of greater than 80%, the protective fabric having a circular bend of between one and ten lbs, at least 20% of the fibers by weight of the total of all fibers present in each of the yarns of the single ply being protective fibers having greater than 12 gpd tenacity, and the single ply having a fabric mass greater than 3.35 oz/yd2.

20. The single ply of claim 19, wherein the single ply has a textile construction having less than 90% of available crossing points.

21. The single ply of claim 19, wherein the single ply has a permeability of less than 60 cfm/ft2, as measured using a Frazier differential-pressure air permeability tester.

22. The single ply of claim 19, wherein the single ply has a Ref of less than 15 units, as measured according to ASTM standards using a sweating guarded hotplate.

23. The single ply of claim 19, wherein the single ply is woven with a twill or satin weave.

24. The single ply of claim 19, wherein the protective fibers of the single ply include para-aramid and/or liquid crystal polyester ("LCP") fibers.

25. The single ply of claim 19, wherein the single ply further includes a primer coating representing greater than 3% by weight of the single ply, the primer covering substantially all surfaces of all fibers in the single ply.

26. The single ply of claim 25, wherein the coating provides UV protection, abrasion protection, and/or color acceptance.

27. The single ply of claim 19, wherein the Frazier ASTM permeability of the single ply is less than 30 cfm/ft2.

28. A single ply of a protective fabric suitable for making a protective garment, the single ply being a woven ply, the single ply comprising:

a first plurality of yarns directed in a first yarn direction of the woven ply and a second plurality of yarns directed in an intersecting second yarn direction of the woven ply, all of the yarns of the single ply that are directed in the first yarn direction being staple yarns, and all of the yarns of the single ply that are directed in the second direction being filament yarns, each of the staple and filament yarns including at least one fiber, the single ply having a V50 for 2 gr RCC fragment of greater than 350 feet per second ("fps"), as measured using Mil Std test method 662F;

the single ply having a simple combined cover factor of greater than 80%, the single ply having abrasion resistance greater than 5,000 cycles against 400 grit using Martindale abrasion method, at least 20% of the fibers by weight of the total of all fibers present in each of the yarns of the single ply having a tenacity greater than 12 gpd, and the single ply having a fabric mass between 3.35 oz/yd2 and 15.9 oz/yd2.

29. The single ply of claim 28, wherein the single ply further includes a protective coating representing greater than 3% by weight of the single ply.

30. The single ply of claim 28, wherein the Tensile Property loss of the single ply after 25 AATCC standard washings is less than 10%.

31. The single ply of claim 28, wherein the single ply has a UV exposure tensile loss of less than 15% when exposed to UV irradiation according to AATCC TM186 test conditions.

32. The single ply of claim 28, wherein the single ply has an ASTM vertical flame consumption of less than 50%.

33. The single ply of claim 28, wherein the single ply has an EN388/ANSI 150 puncture greater than 3.

34. The single ply of claim 28, wherein the single ply is woven with a twill or satin weave.

35. The single ply of claim 28, wherein the protective fibers of the single ply include para-aramid and/or liquid crystal polyester ("LCP") fibers.

36. The single ply of claim 28, wherein the single ply further includes a primer coating representing greater than 3% by weight of the single ply, the primer covering substantially all surfaces of all fibers in the single ply.

37. The single ply of claim 36, wherein the coating provides UV protection, abrasion protection, and/or color acceptance.

38. The single ply of claim 28, wherein the Frazier ASTM permeability of the single ply is less than 30 cfm/ft2.

39. The single ply of claim 10, wherein the single ply is incorporated in a protective garment, and the protective garment is configured so as to bring the single ply into contact with skin of a user wearing the garment.

40. The single ply of claim 28, wherein the single ply is incorporated in a protective garment, and the protective garment is configured so as to bring the single ply into contact with skin of a user wearing the garment.

41. The single ply of claim 1, wherein the single ply has a REF value that is between 3 and 6.

42. The single ply of claim 10, wherein the single ply has a REF value that is between 3 and 6.

43. The single ply of claim 19, wherein the single ply has a REF value that is between 3 and 6.

44. The single ply of claim 28, wherein the single ply has a REF value that is between 3 and 6.

* * * * *